US007168684B2

(12) United States Patent
Marroncles et al.

(10) Patent No.: US 7,168,684 B2
(45) Date of Patent: Jan. 30, 2007

(54) TILTABLE VALVE FOR DISCHARGING FOAM AND OTHER MEDIA

(75) Inventors: Alain Marroncles, Saint Maur Des Fossés (FR); Hervé Bodet, Verdun (FR)

(73) Assignee: Lindal Ventil GmbH (DE)

( * ) Notice: Subject to any disclaimer, the term of this patent is extended or adjusted under 35 U.S.C. 154(b) by 134 days.

(21) Appl. No.: 10/961,255

(22) Filed: Oct. 8, 2004

(65) Prior Publication Data

US 2005/0077494 A1 Apr. 14, 2005

(30) Foreign Application Priority Data

Oct. 13, 2003 (DE) ..... 203 15 714 U

(51) Int. Cl.
*F16K 31/00* (2006.01)

(52) U.S. Cl. ..... 251/354; 222/402.22

(58) Field of Classification Search ..... 251/331, 251/349, 354; 222/402.21, 402.22, 402.23
See application file for complete search history.

(56) References Cited

U.S. PATENT DOCUMENTS 2,704,172 A * 3/1955 Lapin ..... 222/402.22
3,048,307 A * 8/1962 Daniel ..... 222/402.22
3,731,847 A * 5/1973 Webster ..... 222/94
4,426,026 A * 1/1984 Knickerbocker ..... 222/402.13
4,824,075 A * 4/1989 Holzboog ..... 251/349
5,167,347 A * 12/1992 Wiegner et al. ..... 222/94

* cited by examiner

*Primary Examiner*—Edward K. Look
*Assistant Examiner*—John K. Fristoe, Jr.
(74) *Attorney, Agent, or Firm*—Peter J. Bilinski

(57) ABSTRACT

A tiltable valve for discharging foam and other media from a pressurized vessel includes a valve disk for connection to the vessel, and a valve body having a holder opening that is placed in an opening in the valve disk and a sealing surface at a side facing away from the valve disk. The tiltable valve further includes a valve element disposed in the holder opening which has a tubular portion with a sealing flange at one end and at least one inlet opening in the wall, such that in a closed position of the valve, the sealing flange bears on the sealing surface and blocks an entry of the medium requiring discharge in the inlet opening and, in a tilted position of the valve element, the sealing flange and the sealing surface are spaced from each other while forming a gap and the medium requiring discharge is allowed to exit through the gap and the inlet opening. A blocking body is disposed in the tubular portion of the valve element and unblocks, or at least partially closes, the inlet opening in response to the pressure in the vessel, the inlet opening being increasingly unblocked when the pressure drops.

11 Claims, 2 Drawing Sheets

TILTABLE VALVE FOR DISCHARGING FOAM AND OTHER MEDIA

FIELD OF THE INVENTION

The present invention relates to a tiltable valve for discharging foam and other media. Such valves are employed particularly for discharging polyurethane foam, but also can be used in the foodstuff sector.

SUMMARY OF THE INVENTION

Known tiltable valves have a valve disk which is crimped together with a vessel body. A valve body having a holding opening is retained in a central opening in the valve disk. The valve body, which is also called a molded piece, has a sealing surface serving as a valve seat, at a side facing away from the valve disk. A valve element is disposed in the holding opening of the valve body and has a tubular portion with a sealing flange at one end and inlet openings in the tube wall near the sealing flange. When the valve is in its closed position, the sealing flange bears on the sealing surface and prevents the escape of the medium requiring discharge, through the inlet openings in the tubular portion of the valve element. When the valve element is in its tilted position in which a valve stem projecting from the holding opening is inclined from the longitudinal axis, a gap is formed between the sealing flange and the sealing surface through which a medium requiring discharge gets to the inlet opening and escapes therethrough and through the tubular portion.

When it is used, the pressure will drop in the vessel interior and the mass flow will decrease while the pressure is dropping.

SUMMARY OF THE INVENTION

It is an object of the invention to provide a tiltable valve which uses simple means to ensure a constant mass flow from the vessel even at a dropping pressure.

According to the invention, the object is achieved by a tiltable valve having the features of claim 1. Advantageous aspects constitute the subject matter of the dependent claims.

The inventive tiltable valve according to a preferred aspect of the invention has a blocking body which is disposed in the tubular portion of the valve element and unblocks, or at least partially closes, the inlet opening in the valve element in response to the pressure in the vessel. The situation is such that the inlet opening is increasingly unblocked when the pressure drops, causing the inlet opening in the tubular portion of the valve element to become increasingly larger when the pressure drops.

In a preferred aspect, the blocking body is formed as an elastic membrane member. The pressure prevailing in the vessel causes the elastic membrane member to be forced deeper into the outlet channel in response to the intensity of the pressure and, thus, to partially close the inlet opening depending on the pressure value.

Preferably, the membrane member has a closing portion adapted in cross-section to the valve element in the area of the inlet opening and a holding portion projecting from the valve element. It is preferred that the holding portion preferably has a circumferential flange which is curved away from the valve element and biases the closing portion to a position which unblocks the inlet opening. The closing portion is resiliently supported with the holding portion, the pressure in the interior counteracting the elastic force. Preferably, the closing portion has a bottom area and a cylindrical side wall, the closing portion being open towards the holding portion.

In a preferred aspect, the valve element has a cap which receives the membrane member. The cap secures the holding portion of the membrane member on the valve element and has at least one through passage for the membrane member to be subjected to the internal pressure of the vessel. In an appropriate aspect, the cap grips around the sealing flange at least partially and is locked in place thereon.

In a preferred aspect, the inlet opening is formed as an elongate hole which extends in the axial direction of the valve element. The inlet opening is unblocked completely when the medium is discharged nearly completely. The unblocked inlet opening enables the medium to escape to a maximum extent when the pressure has dropped. When the pressure is completely applied to the vessel the membrane member partially closes the inlet opening.

It is useful for the valve element to have at least four equally spaced inlet openings.

BRIEF DESCRIPTION OF THE DRAWINGS

A preferred aspect of the inventive tiltable valve will be described in more detail with reference to the following figures, in which.

DETAILED DESCRIPTION

Figure 1:
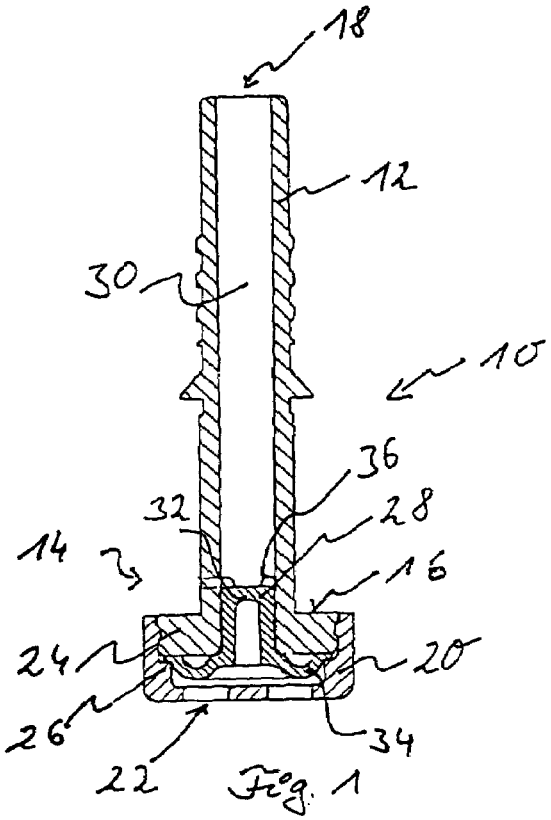
FIG. 1 shows a valve element according to the present invention when subjected to a high pressure.

FIG. 1 shows an inventive valve element 10 with a projecting valve stem 12 and a valve element 14 integrally formed therewith which has a sealing surface 16. The valve element 10 has an exit opening 18 through which the medium requiring discharge escapes. At the side opposed to the exit opening 18, the valve element has placed thereon a cap 20 which has passage openings 22. The cap 20 is locked in place in a circumferential flange 24 which partially defines the sealing surface 16. On its inner wall, the cap 20, which is of a cup-shaped design, has appropriately formed locking lugs (not numbered) which engage a respective circumferential recess (not numbered) in the flange 24. The cap 20 further has a circumferential step 26 which reduces the inside diameter in the cap. The seating area 16 is defined by the surface of the flange 24 and the edge of the cap 20.

The end of the valve element 10 that faces away from the exit opening 18 has inserted therein an elastic membrane member 28. The membrane member 28 has a cylindrical portion 32 extending into the outlet channel 30 and a holding portion 34 bearing on the flange 24 on the side turned away from the exit opening 18. The holding portion 34 is clamped in place along its circumference between the step 26 of the cap 20 and the flange 24.

An entry of the medium requiring discharge into the outlet channel 30 takes place through inlet openings 36 which are disposed close to the sealing surface 16 in the wall of the outlet channel.

Figure 2:
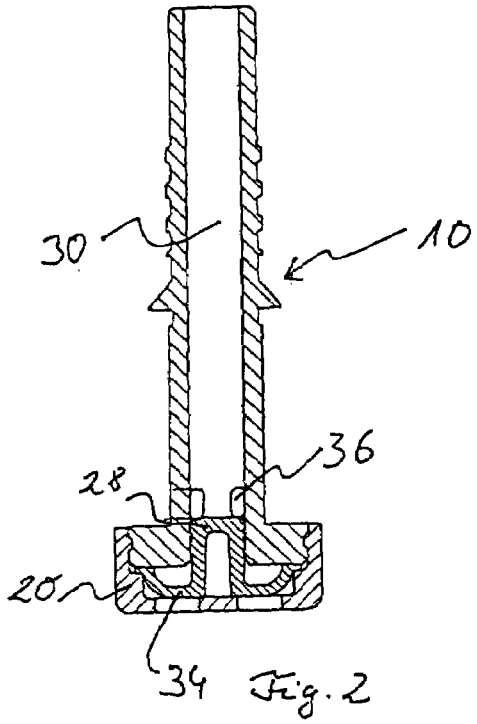
FIG. 2 shows the inventive valve element of FIG. 1 when subjected to a low pressure.

In FIG. 1, the elastic membrane member is forced into the through channel 30 to a maximum extent and partially closes the inlet openings 36. FIG. 2 shows the elastic membrane member 28 in a retracted position in which the inlet openings 36 are unblocked in the channel 30. The elastic membrane member 28 is resiliently biased to the retracted position by means of its holding portion and the clamping fixation thereof by the cap 20.

FIG. 1 shows the inventive valve element at a high pressure in the vessel that forces the elastic membrane member 28 into the through channel 30. FIG. 2 shows the elastic membrane member 28 at a low pressure in a vessel at which the bias by the holding portion 34 is sufficient to retract the closing portion 32 from the through channel and to unblock the inlet openings completely. Thus, the elastic membrane member regulates the mass flow entering the through channel 30 in dependence on the pressure. The above described dimensions of the elastic membrane member achieve that a nearly constant mass flow escapes throughout a large pressure range.

The preceding embodiment was described with reference to an elastic membrane member which is fixed to the valve element 10 via a cap 20. In addition to an alternative embodiment, it is also conceivable to use a rigid body as a closing body for the inlet opening 36 that is resiliently biased to unblocked the position of FIG. 2.

Figure 3:
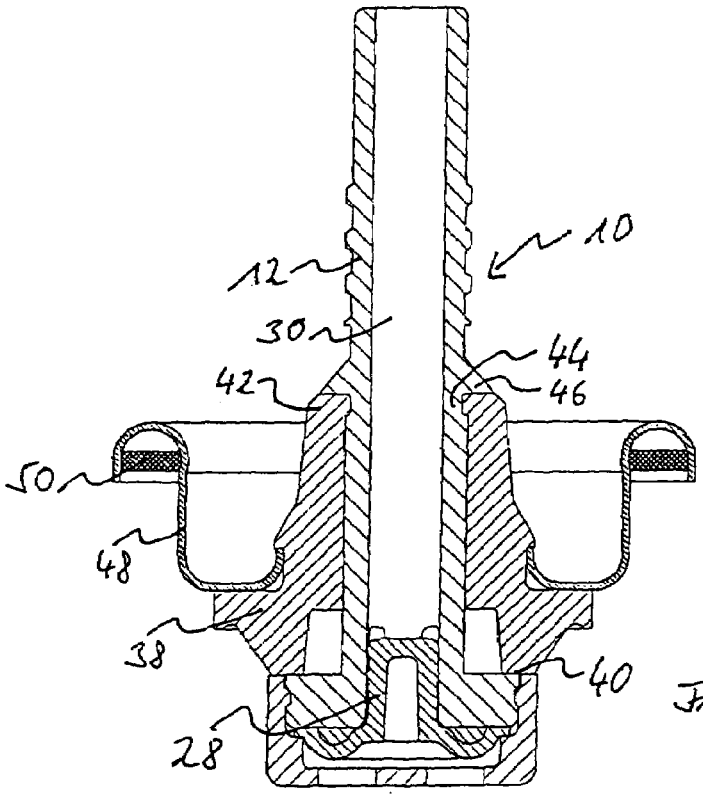
FIG. 3 shows the inventive valve element of FIGS. 1 and 2 with a valve body and valve disk.

FIG. 3 shows the complete construction of the inventive tiltable valve with the valve element 10 of FIGS. 1 and 2. The valve element 10 is mounted in a valve body 38. The valve body 38 has a sealing surface 40 which defines the valve seat at its side facing the sealing surface 16. The valve body 38 bears on the valve element 10 and causes a projection 42 to engage a recess 44. In addition, the valve element 10 is secured by a projection 46 on the valve stem against an axial displacement into the vessel. Connected to the valve body 38 is the valve disk 48 which radially stands up outwardly. Along the outer circumference, the valve disk 48 is crimped together with a vessel for the medium requiring discharge, it being also preferred to employ a sealing 50 of buna here.

FIG. 3 shows the inventive valve in its closed position. To open the valve, the stem 12 is tilted in the valve body, causing a gap (not shown) to be formed between the sealing surface 16 of the valve member 40 and the valve body. A medium contained in the vessel enters this gap because of the vessel's internal pressure and enters the channel 30 through the inlet opening 36. For the given pressure, the mass flow depends upon the magnitude of the unblocked inlet opening 36. This one, in turn, is adjusted by the elastic membrane member 28 in dependence pressure.

Figure 4:
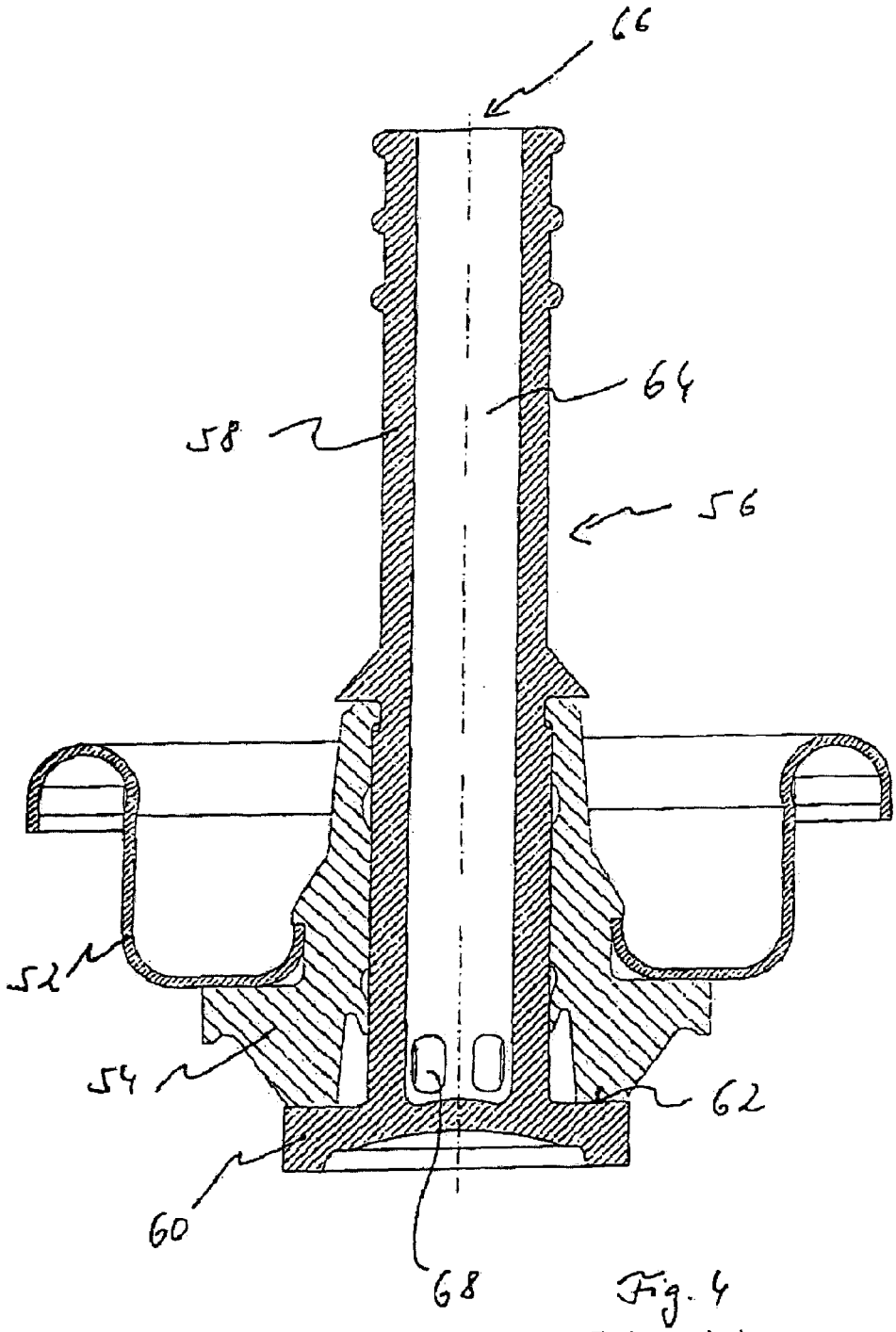
Fig. 4 Prior Art
FIG. 4 shows a tiltable valve according to the state of the art.

In the known tiltable valve illustrated in FIG. 4, the valve disk 52 and the valve body 54 are substantially identical to the inventive valve. The valve element 56 again has a valve stem 58 and a valve member 60. The valve member 60 has a seating area 62 which is integrally formed.

In contrast to the inventive valve element, the through channel 64 is closed at the side facing away from the outlet opening 66. When the valve stem 58 is actuated the sealing surface 62 moves away from the valve body 54 and the pressurized medium will get into the outlet channel 64 through the inlet openings 68.

We claim:

1. A tiltable valve for discharging foam and other media from a pressurized vessel, comprising:

a valve disk for connection to said vessel;

a valve body having a holder opening, said valve body being placed in an opening in said valve disk and having a sealing surface at a side facing away from said valve disk;

a valve element disposed in said holder opening, said valve element having a tubular portion with a sealing flange at one end and at least one inlet opening in a wall; wherein, in a closed position of said valve, said sealing flange bears on said sealing surface and blocks an entry of said medium requiring discharge in said inlet opening and, in a tilted position of said valve element, said sealing flange and said sealing surface are spaced from each other while forming a gap and said medium requiring discharge is allowed to exit through said gap and said inlet opening; and a blocking body disposed in the tubular portion of said valve element which unblocks, or at least partially closes, said inlet opening in response to the pressure in said vessel, said inlet opening being increasingly unblocked when the pressure drops.

2. The tiltable valve according to claim 1, wherein said blocking body is formed as an elastic membrane member.

3. The tiltable valve according to claim 2, wherein said membrane member has a closing portion adapted in cross-section to said valve element in the area of said inlet opening, and a holding portion projecting from said valve element.

4. The tiltable valve according to claim 3, wherein said holding portion is biased to a position in which said closing portion completely unblocks said inlet opening.

5. The tiltable valve according to claim 4, wherein said closing portion includes a bottom area and a cylindrical side wall and is open towards said holding portion.

6. The tiltable valve according to claim 5, wherein said valve element includes a cap which receives said elastic membrane member.

7. The tiltable valve according to claim 6, wherein said cap secures said holding portion of said membrane member in the biased position and has at least one through passage.

8. The tiltable valve according to claim 6, wherein said cap grips around said sealing flange at least partially and is locked in place thereon.

9. The tiltable valve according to claim 2, wherein said inlet opening is formed as an elongate hole and said membrane member unblocks said inlet opening completely when the medium is nearly completely discharged.

10. The tiltable valve according to claim 2, wherein said inlet opening is formed as an elongate hole and said membrane member, when acted upon by a nearly complete pressure, partially closes said inlet opening.

11. The tiltable valve according to claim 1, wherein at least four equally spaced inlet openings are provided.

* * * * *